US006581736B1

(12) United States Patent
Scicluna

(10) Patent No.: US 6,581,736 B1
(45) Date of Patent: Jun. 24, 2003

(54) BAG WITH UMBRELLA STORAGE SLEEVE

(75) Inventor: Paul Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 10/251,070

(22) Filed: Sep. 20, 2002

(51) Int. Cl.[7] ..... A45C 2/00; A45C 13/00; A45C 13/40

(52) U.S. Cl. ..... 190/109; 190/102; 190/110; 150/106; 150/116; 224/915

(58) Field of Search ..... 190/102, 109, 190/110; 150/106, 113, 116; 224/915; 135/34.2

(56) References Cited

U.S. PATENT DOCUMENTS

| | | | | | |
|---|---|---|---|---|---|
| 782,357 | A | * | 2/1905 | Pogue | 224/915 X |
| 1,892,602 | A | * | 12/1932 | Beehler | 224/915 X |
| 1,958,003 | A | * | 5/1934 | Heyman | 190/102 |
| 2,369,943 | A | * | 2/1945 | Broudy | 190/102 |
| 2,394,332 | A | * | 2/1946 | Salem | 190/102 |
| 2,448,404 | A | * | 8/1948 | Ackerman | 150/106 |
| 2,616,471 | A | * | 11/1952 | Feigl et al. | 150/106 |
| 3,957,141 | A | * | 5/1976 | Domes | 190/102 |
| 4,171,011 | A | * | 10/1979 | Kopin | 190/102 |
| 4,354,542 | A | * | 10/1982 | Gerch | 190/102 |
| 4,828,081 | A | * | 5/1989 | Nordstrom et al. | 190/102 |
| 5,890,809 | A | * | 4/1999 | Nelson | 383/40 |
| 6,109,402 | A | * | 8/2000 | Godwhaw et al. | 190/102 X |
| 6,311,885 | B1 | * | 11/2001 | Miller | 224/915 X |

FOREIGN PATENT DOCUMENTS

| | | | | |
|---|---|---|---|---|
| DE | 2807305 | * | 8/1979 | |
| GB | 2257028 | * | 1/1993 | 190/102 |
| JP | 1132830 | * | 2/1999 | |
| JP | 2002125734 | * | 5/2002 | |

* cited by examiner

*Primary Examiner*—Sue A. Weaver
(74) *Attorney, Agent, or Firm*—Baker Botts LLP

(57) ABSTRACT

A bag, of tote or briefcase size, includes an umbrella sleeve which is easily accessible. The sleeve comprises a stiff backing member and an elastic mesh material attached thereto to form an open-ended pocket. When not in use, the umbrella sleeve is stowed within a bottom pocket of the bag. When needed to hold an umbrella, the umbrella sleeve is pulled from the stowed position and placed in a use position, in which the umbrella sleeve is temporarily affixed to a side of the bag. In the use position, the umbrella sleeve is ready to receive an umbrella for storage while promoting drying, if the umbrella is wet. When the umbrella sleeve is no longer needed, it may be returned to the stowed position by the aid of the stiff backing member.

10 Claims, 3 Drawing Sheets

BAG WITH UMBRELLA STORAGE SLEEVE

BACKGROUND OF INVENTION

1. The Field of the Invention

The present invention relates to bags, such as luggage, business cases, carry-on bags, totes and the like, and more particularly to a bag having incorporated therein an umbrella storage sleeve.

2. Description of the Related Art

One of the most recurring problems for travelers in inclement weather is where to stow a wet umbrella when not in use. One surely cannot place a wet umbrella in a bag, as the contents of the bag will get wet. Likewise, carrying around a wet umbrella can be quite cumbersome and awkward.

Many different solutions have been attempted to solve this problem. First, many umbrellas feature a non-porous cover which can be placed over the umbrella. However, such a cover promotes mildew, as the wet umbrella placed inside the cover will not dry easily. Another attempted solution is simply opening the umbrella and placing it on the floor to promote quick drying. This is problematic because such space is not always available, as, for example, when a traveler is on an airplane or other public transportation. Further, this customary method can be an eye sore.

Yet another attempt to solve this problem is the umbrella stand or bucket method. This is where a stand is provided, usually near a front door of a home or office, to place or stow a wet umbrella. However, this approach is not practical while the traveler is in transit and, moreover, can lead to confusion in the identification of one's umbrella.

There remains a need, therefore, for enabling a person in transit to properly stow a wet umbrella which will not pose an inconvenience.

SUMMARY OF THE INVENTION

It is an object of the present invention to fulfill the foregoing and other needs of the prior art by the provision of a bag, e.g., of the tote or hand-carried size, having an integral umbrella sleeve forming an open-ended pocket for the convenient storage and drying of an umbrella. The umbrella sleeve is preferably stowed in a pocket in the bottom of the bag, and may be extracted therefrom when needed to stow an umbrella. Once fully extracted, the umbrella sleeve may be temporarily affixed to the side of the bag with the open end upward. In this use position, an umbrella may be inserted into the umbrella sleeve to allow easy and discrete carrying of an umbrella whether wet or dry. When no longer needed, the umbrella sleeve may be returned to the stowed position at the bottom of the bag. The removal from and return to the stowed position is aided by a stiffened backing member of the umbrella sleeve, which provides the stiffness needed to easily insert the umbrella sleeve into the storage pocket.

In one embodiment of the invention, the umbrella sleeve is preferably made of an elastic mesh with a firm backing member on one side. The backing member preferably extends beyond the open end of the sleeve to provide a firm lip for gripping by the user. The umbrella sleeve is pulled from the storage pocket by pulling on the lip. Conversely, the umbrella sleeve is returned to the storage pocket by grasping the lip and pushing the umbrella sleeve back into the pocket. In this way, the umbrella sleeve may be stowed in the bottom of the bag or moved to a use position, affixed to the side of the bag, as desired, thus providing selectable storage of the umbrella sleeve, or storage of an umbrella in a revealed umbrella sleeve.

BRIEF DESCRIPTION OF THE DRAWINGS

For a more complete understanding of the present invention and the advantages thereof, reference may be made to the following description of an exemplary embodiment thereof, taken in conjunction with the accompanying drawings, in which.

DESCRIPTION OF AN EXEMPLARY EMBODIMENT

Figure 1:
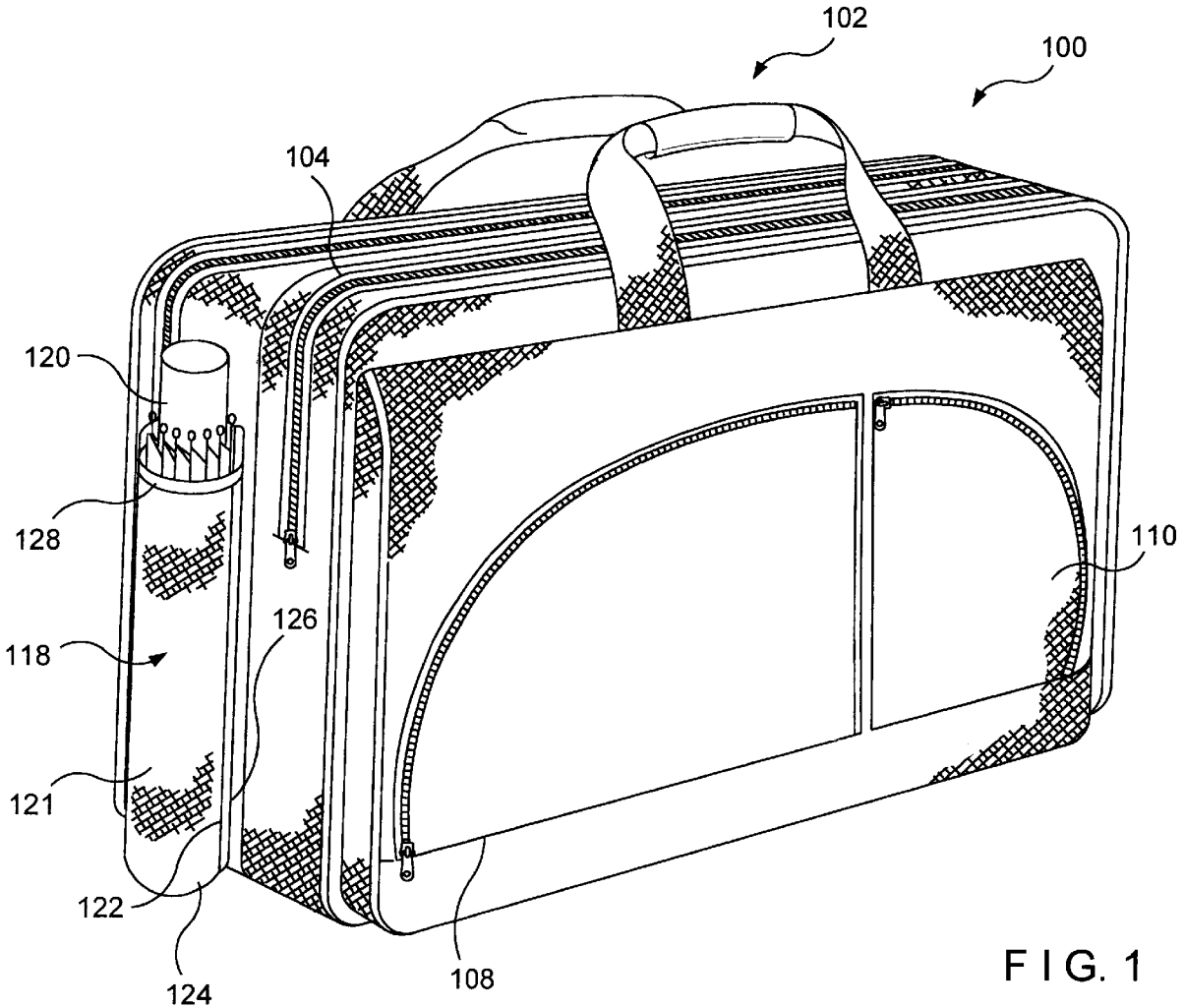
FIG. 1 is a perspective view of a bag having an integral umbrella sleeve which is easily accessible in accordance with the present invention, showing an umbrella stowed in the sleeve.

FIG. 1 depicts a bag or luggage item 100, e.g. of tote or briefcase size, which is adapted to be carried by an individual by means of the handles 102 or a shoulder strap (not shown). Such a bag would typically include one or more zippered main pockets 104 for papers, overnight articles, and the like, and one or more side or exterior pockets 108, 110 for storage of readily accessible items. In the usual case, the bag 100 would be carried with a person when traveling on business or vacation, or simply traveling to the office. The exterior of the bag may be made of any suitable material, such as the fabrics customarily used to cover "soft" briefcases or the like, e.g., ballistic nylon fabric.

In accordance with the present invention, an umbrella storage sleeve 118 is integrated into the bag 100. As shown in FIG. 1, the sleeve 118 is in its use position with an umbrella 120 stowed therein. The umbrella sleeve 118 is preferably constructed of an expandable soft porous material 121, such as an elastic mesh fabric. Expandability is desirable so that umbrellas of different sizes and shapes may be inserted and snugly held within the sleeve. The material is preferably porous to facilitate drainage and to promote air flow for drying of wet umbrellas. The elastic mesh 121 is attached along its lengthwise edges 122 (only one of which is visible in FIG. 1) and at the lower end 124 to a stiff elongated backing member 126. An opening 128 is provided at the upper end of the sleeve 118 for insertion of an umbrella 120.

Figure 3:
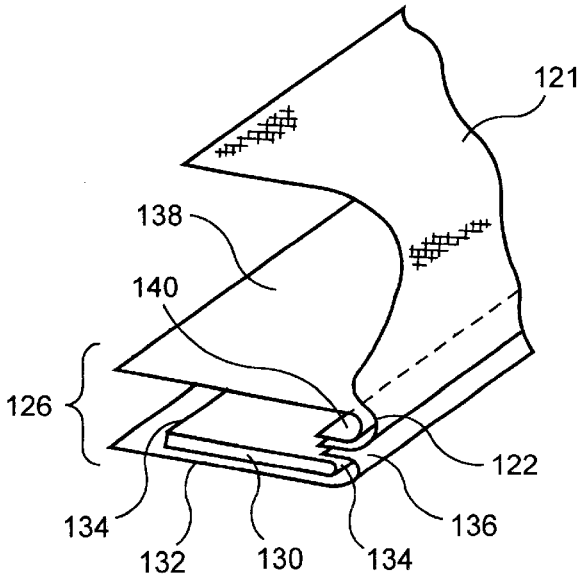
FIG. 3 is a schematic view showing the details of construction of one embodiment of an umbrella sleeve in accordance with the present invention.

FIG. 3 illustrates the construction of one embodiment of the umbrella sleeve 118 in more detail. As there shown, the stiff backing member 126 is preferably made up of a flexible, but stiff, core member 130 of any suitable material, e.g., polyethylene, which is covered on both sides and at the ends by a water-resistant material, e.g., the same fabric of which the bag 100 is made. As shown schematically in FIG. 3, a layer 132 of the water-resistant material covers the back of the core 130 and is turned over at each lengthwise edge 134 thereof, as indicated at 136. Although, for clarity, the fabric layer 132 is not shown as turned over the left-hand edge 134 in FIG. 3, it will be understood that it would be turned thereover in the same way as shown at 136 for the right-hand edge.

A fabric layer 138 covers the front surface of the core 130 and is turned under at each edge, as indicated at 140 for the right-hand edge in FIG. 3. One edge 122 of the elastic mesh fabric 121 is inserted between the turned-over edges of the fabric layers 132, 138, and all three fabrics are then stitched to the core 130 along the edge 134. The same assembly is carried out at the left-hand edge 134 in FIG. 3.

Figure 2A:
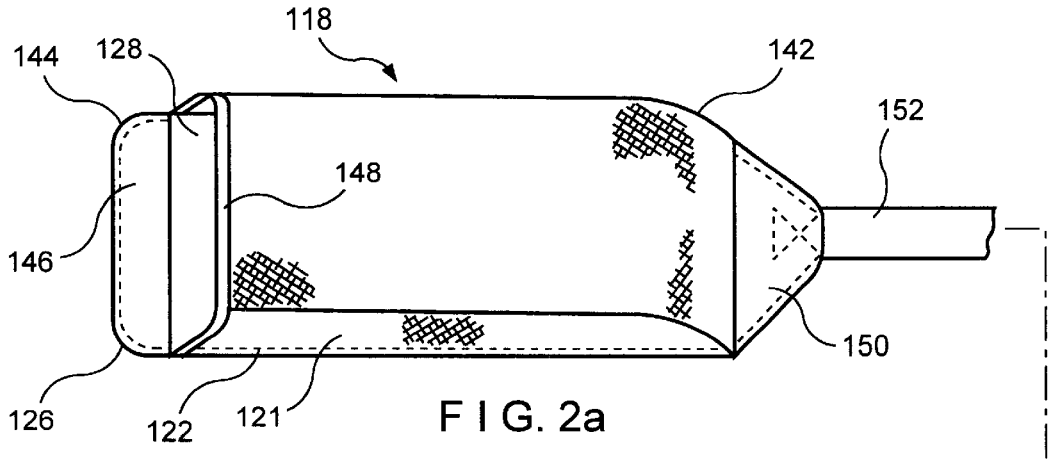
FIGS. 2(*a*) and 2(*b*) are expanded views showing how the umbrella sleeve of FIG. 1 is assembled within a storage pocket on the bag.
Figure 2B:
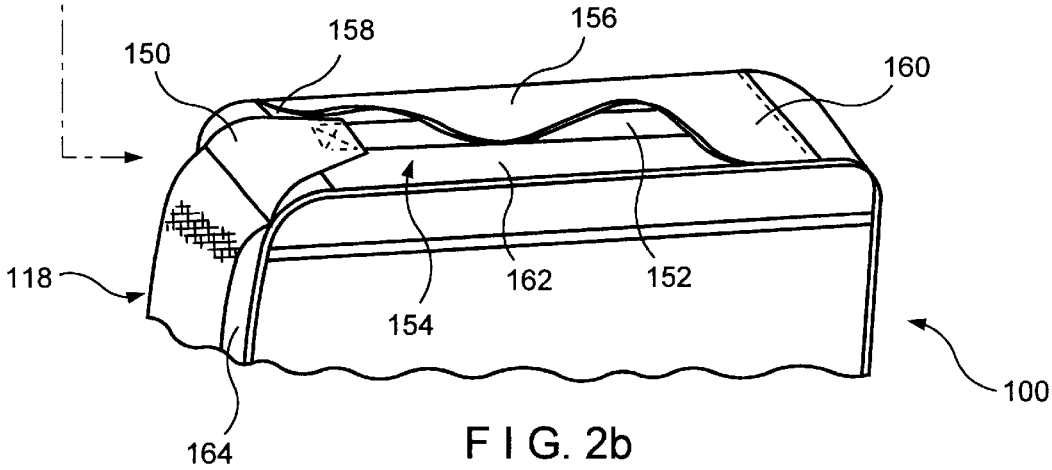

As shown in FIG. 2(*a*), the elastic mesh fabric 121 extends from one end 142 of the backing member 126, at which end 142 the mesh fabric is attached to the backing member 126 to form a closed pocket, to a distance short of the other end 144 of the backing member 126, leaving a lip-like portion 146 of the backing member 126 extending beyond the open end 128 of the mesh fabric 121. As described more fully hereinafter, the lip 146 may be gripped by the user to move the sleeve 118 into the desired position. The open end 128 is preferably surrounded by an elastic border 148 to ensure a tight grip around the umbrella when stowed within the sleeve 118.

At the closed end 142 of the sleeve 118, the backing member 126 is attached to a generally triangular-shaped web 150, which in turn is attached at its apex to a strap-like member 152. As shown in FIG. 2(*b*), the other end of the strap 152 extends within a pocket 154 formed by a layer 156 of fabric stitched or otherwise attached to the bottom 162 of the bag 100. The pocket 154 is open at one end 158 and closed at the other end 160, where the fabric layer 156 is attached to the bag side.

The free end of the strap 152 is securely attached to the bag 100 and/or the fabric layer 156 at the closed end 160 of the pocket 154. The strap 152 is preferably long enough, when fully extended, to permit the web 150 to extend out through the open end 158 of the pocket 154, so as to allow the sleeve 118 to be turned upwardly along an adjacent side 164 of the bag 100 to the use position shown in FIG. 1. To that end, the strap 152 may be made of an elastic material, which stretches when the sleeve 118 is pulled out of the pocket 154, or of inelastic material of a sufficient length to permit the withdrawal of the sleeve 118. When not in use, the sleeve 118 is conveniently stowed in the pocket 154.

Figures 4, 5, 6:
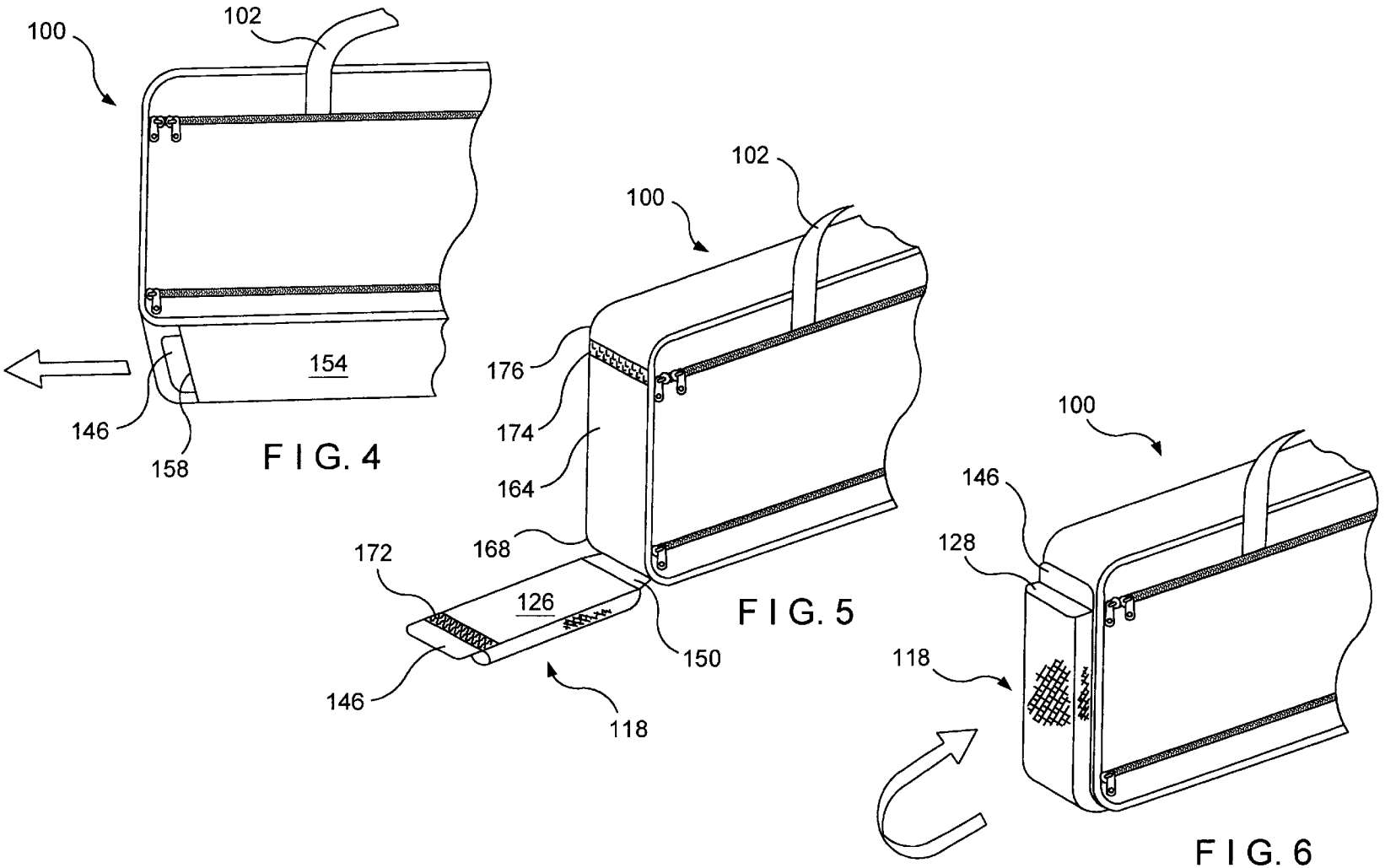
FIG. 4 is a view of the umbrella sleeve of FIGS. 2(*a*) and 2(*b*) stowed in a bottom pocket of the bag in accordance with the present invention.
FIG. 5 is an illustration of the umbrella sleeve of FIGS. 2(*a*) and 2(*b*) as it is removed from the bottom pocket of the bag in accordance with the present invention.
FIG. 6 is an illustration of the umbrella sleeve of FIGS. 2(*a*) and 2(*b*) temporarily affixed to the side of the bag and ready for umbrella insertion in accordance with the present invention.

FIGS. 4, 5 and 6 illustrate the movement of the sleeve 118 from its stowed position within the pocket 154 to the use position of FIG. 1. In the stowed position shown in FIG. 4, only the lip 146 of the sleeve 118 extends out of the open end 158 of the pocket 154. The remainder of the sleeve is hidden from view within the pocket 154. So positioned, the lip 146 may readily be gripped by the user to pull the sleeve 118 out of the pocket 154 in the direction of the arrow in FIG. 4 to the position shown in FIG. 5.

In the position of FIG. 5, the strap 152 is fully extended and the web 150 underlies the lower end 168 of the side 164 of the bag 100. From this position, the sleeve 118 is folded or turned upwardly in the direction of the arrow in FIG. 6 to the use position. The sleeve 118 is held in the use position by joining a strip 172 of hook-fastener material (see FIG. 5) attached to the back of the backing member 126 adjacent the open end of the sleeve 118 to a strip of loop-fastener material 174 attached to the side 164 of the bag 100 near its upper end 176. In this way, the umbrella sleeve 118 may be temporarily affixed to the side 164 of the bag 100 (see FIG. 6), ready for the insertion therein of an umbrella (wet or dry), as shown at 120 in FIG. 1.

When the umbrella sleeve 118 is no longer needed, the sleeve 118 may be detached from bag side 164 by simply pulling the sleeve 118 from the bag, thus releasing the hook-and-loop fastener strips 172, 174. Then, by grasping the umbrella sleeve 118 by the lip 146 and aligning the umbrella sleeve 118 on the same plane as the bottom pocket 154, the umbrella sleeve 118 may be returned to the stowed position simply by pushing the sleeve 118 back into the bottom pocket 154. The stiff backing member 126 makes this very easy. The elastic mesh 121 of the umbrella sleeve 118 also facilitates the insertion of the sleeve 118 into the pocket 154, as it allows the sleeve 118 to contract and flatten when the umbrella is withdrawn from the sleeve.

Although the invention has been described herein by reference to an exemplary embodiment thereof, it will be understood that such embodiment is susceptible of modification and variation without departing from the inventive concepts disclosed. All such modifications and variations, therefore, are intended to be encompassed within the spirit and scope of the appended claims.

What is claimed is:

1. In a bag having a bottom and sides extending upwardly from the bottom, the improvement comprising:

an umbrella sleeve having an open end and a closed end and forming a pocket for the receipt therein of an umbrella;

an open-ended pocket on the bottom of the bag for the storage therein of the umbrella sleeve when not in use;

an extensible member attached at one end to the closed end of the umbrella sleeve and at the other end to the interior of the bottom pocket, the extensible member being of a length sufficient to permit the umbrella sleeve to be withdrawn from the bottom pocket and extended upwardly along a side of the bag with the open-end thereof facing upwardly; and means carried in part by the umbrella sleeve and in part by the side of the bag for releasably attaching the umbrella sleeve to the bag side.

2. The bag of claim 1, wherein the umbrella sleeve comprises an elastic material attached to a stiffened backing member.

3. The bag of claim 2, wherein the elastic material comprises an elastic mesh.

4. The bag of claim 2, wherein the backing member comprises a stiff core.

5. The bag of claim 4, wherein the backing member comprises a fabric covering the core.

6. The bag of claim 4, wherein the core comprises polyethylene.

7. The bag of claim 2, wherein the backing member includes a lip extending beyond the open end of the sleeve.

8. The bag of claim 7, wherein the lip of the backing member extends beyond the open end of the bottom pocket when the umbrella sleeve is stored therein.

9. The bag of claim 1, wherein the releasably attaching means comprises a first strip of one half of a hook-and-loop fastener material attached to the backing member and a second strip of the other half of the hook-and-loop fastener material attached to the bag side.

10. The bag of claim 9, wherein the first strip is attached to the backing member adjacent the open end of the sleeve and the second strip is attached to the bag side adjacent the upper end thereof.

* * * * *

UNITED STATES PATENT AND TRADEMARK OFFICE

CERTIFICATE OF CORRECTION

PATENT NO. : 6,581,736 B1
DATED : June 24, 2003
INVENTOR(S) : Scicluna, Paul

It is certified that error appears in the above-identified patent and that said Letters Patent is hereby corrected as shown below:

Column 1,
Line 26, “eye sore” should read -- eyesore --

Column 4,
Line 38, “open-end” should read -- open end --

Signed and Sealed this

Fourteenth Day of October, 2003

JAMES E. ROGAN
*Director of the United States Patent and Trademark Office*